US008770698B2

(12) United States Patent
Ochiai

(10) Patent No.: US 8,770,698 B2
(45) Date of Patent: Jul. 8, 2014

(54) PRINT CONTROL METHOD AND PRINT APPARATUS

(75) Inventor: Takayuki Ochiai, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 12/957,291

(22) Filed: Nov. 30, 2010

(65) Prior Publication Data

US 2011/0211006 A1 Sep. 1, 2011

(30) Foreign Application Priority Data

Feb. 26, 2010 (JP) ..... 2010-042347

(51) Int. Cl.

| | |
|---|---|
| ***B41J 29/38*** | (2006.01) |
| ***B41J 11/66*** | (2006.01) |
| ***B41J 13/00*** | (2006.01) |
| *B41J 11/00* | (2006.01) |
| *B41J 3/60* | (2006.01) |

(52) U.S. Cl.

CPC ..... *B41J 11/663* (2013.01); *B41J 13/0045* (2013.01); *B41J 11/008* (2013.01); *B41J 3/60* (2013.01)

USPC ..... 347/16; 347/104

(58) Field of Classification Search

CPC ..... B41J 11/663

USPC ..... 347/16

See application file for complete search history.

(56) References Cited

U.S. PATENT DOCUMENTS

| | | | | |
|---|---|---|---|---|
| 4,566,014 | A * | 1/1986 | Paranjpe et al. | 346/25 |
| 6,108,513 | A * | 8/2000 | Landa et al. | 399/384 |
| 6,408,750 | B1 * | 6/2002 | Goto et al. | 101/226 |
| 2004/0109054 | A1 | 6/2004 | Martin | |
| 2005/0174379 | A1 | 8/2005 | Nakazawa | |
| 2006/0107855 | A1 | 5/2006 | Hatayama | |
| 2008/0030535 | A1 | 2/2008 | Okawa | |
| 2008/0159800 | A1 * | 7/2008 | Wada | 400/621 |
| 2009/0189928 | A1 * | 7/2009 | Ino et al. | 347/1 |
| 2010/0238251 | A1 * | 9/2010 | Tsuzawa | 347/104 |

FOREIGN PATENT DOCUMENTS

| | | | |
|---|---|---|---|
| CN | 1122751 | A | 5/1996 |
| CN | 101309803 | A | 11/2008 |
| JP | 10-264475 | A | 10/1998 |
| JP | 11-249346 | A | 9/1999 |
| JP | 2001-001426 | A | 1/2001 |
| JP | 2001-310849 | A | 11/2001 |
| JP | 2002-160410 | A | 6/2002 |
| JP | 2003-063072 | A | 3/2003 |
| JP | 2003-266835 | A | 9/2003 |
| JP | 2004-338322 | A | 12/2004 |

(Continued)

OTHER PUBLICATIONS

English machine translation for JP 11-249346 A, Sep. 17, 1999.*

*Primary Examiner* — Manish S Shah
*Assistant Examiner* — Jeffrey C Morgan
(74) *Attorney, Agent, or Firm* — Canon USA, Inc., IP Division

(57) ABSTRACT

A reference mark is recorded in an area between one image and the next image sequentially printed on a first surface of a continuous sheet. In a print on a second surface of the sheet, the recorded reference mark is read, and a print position of the image on a second surface of the sheet is set. A plurality of images are sequentially printed on the second surface on the basis of this setting.

7 Claims, 7 Drawing Sheets

(56) References Cited

FOREIGN PATENT DOCUMENTS

| | | | |
|---|---|---|---|
| JP | 2007-048109 | A | 2/2007 |
| JP | 2008-126530 | A | 6/2008 |
| JP | 2008-162170 | A | 7/2008 |
| JP | 2009-078886 | A | 4/2009 |
| WO | 2009/005766 | A2 | 1/2009 |

* cited by examiner

PRINT CONTROL METHOD AND PRINT APPARATUS

BACKGROUND OF THE INVENTION

1. Field of the Invention

The present invention relates to a print apparatus and a print control method using a continuous sheet.

2. Description of the Related Art

Japanese Patent Laid-Open NO. 2008-126530 discloses a print apparatus that performs a duplex printing on front and rear faces of a sheet in an inkjet system by using a lengthy continuous sheet wound into a roll. In this apparatus, while an image of a leading edge of the sheet fed from a sheet feeding unit is picked up, print positions for a plurality of subsequent images are set by using this positional information as a reference, and the sheet is cut by a cutter for each image after a print.

As the sheet used in the print apparatus is longer, an accumulation of sheet conveyance errors is larger. Also, in the print apparatus using liquid such as ink, the sheet length itself changes in some cases because of infiltration of moisture into the sheet, evaporation, or heat at the time of drying. As in Japanese Patent Laid-Open NO. 2008-126530, according to a method of picking up an image of a leading edge of the sheet first and using this as a reference for setting a subsequent print position, it is possible to obtain a high accuracy for the print position of the image in the vicinity of the leading edge. However, as being further away from the leading end, an influence of the conveyance error and sheet expansion and contraction is received, and the print displacement becomes larger as the sheet is longer.

In particular, when a plurality of images are disposed and printed sequentially on both faces of a continuous sheet, it is necessary to accurately match the print positions of the images on both the faces to each other, and relative errors of front and rear faces need to be smaller. However, a surface state of the sheet changed upon ink application. In a front face print and a rear face print, the sheet conveyance states are different from each other, and the relative errors tend to be increased. According to the system of Japanese Patent Laid-Open NO. 2008-126530, even when an alignment of the images on the front and rear sides in the vicinity of the leading edge attains a high accuracy, as being further away from the leading end, the influence of the conveyance error and sheet expansion and contraction is received, and an accuracy degradation in the alignment of the image on the front face and the image on the rear side of the sheet is expanded. In other words, as the sheet used in the one-time duplex printing is longer, the displacement of the image on the front face and the image on the rear side tends to be conspicuous.

The present invention has been made on the basis of a recognition of the above-mentioned problems. The present invention provides a print control method and a print apparatus with which when the duplex printing is performed on the continuous sheet, no matter how much the sheet used in the one-time duplex printing is longer, it is possible to suppress the print displacement of the images on the front face and the rear face.

SUMMARY OF THE INVENTION

According to an embodiment of the present invention, there is provided a method of performing duplex printing, the method comprising, printing a plurality of images on a first surface of a sheet that is continuous, recording a reference mark in an area between one image and the next image sequentially printed on the first surface, reversing the sheet where the plurality of images are printed on the first surface, reading the reference mark recorded on the first surface of the reversed sheet, setting a position to be printed of an image on a second surface which is a back of the first surface, on the basis of the reading of the reference mark, and printing a plurality of images on the second surface.

Further features of the present invention will become apparent from the following description of exemplary embodiments with reference to the attached drawings.

DESCRIPTION OF THE EMBODIMENTS

Hereinafter, a description will be provided of a print apparatus using an inkjet system according to an embodiment. The print apparatus of the present example is a high speed line printer that uses a lengthy continuous sheet (long continuous sheet which is longer than a length of a repetitive print unit in a conveying direction (which is referred to as one page or unit image)) and deals with both a simplex printing and a duplex printing. For example, this is suitable to a field of a large amount of prints in a print laboratory or the like. It is noted that according to the present specification, even when a plurality of small images, characters, and spaces are mixed in an area of one print unit (one page), the components included in the relevant area are collectively referred as one unit image. In other words, the unit image means one print unit (one page) in a case where a plurality of pages are sequentially printed on the continuous sheet. It is noted that this may simply be referred to as image instead of unit image in some cases. A length of the unit image varies in accordance with a size of an image to be printed. For example, for a photograph of L-plate size, the length in a sheet conveying direction is 135 mm, and for A4 size, the length in the sheet conveying direction is 297 mm.

The present invention can widely be applied to print apparatuses such as a printer, a printer multi-function device, a copier, a facsimile apparatus, and a manufacturing apparatus for various devices. A print processing may adopt any system such as the inkjet system, an electrophotography system, a thermal transfer system, a dot impact system, and a liquid development system. Also, the present invention can also be applied to a sheet processing apparatus that performs not only the print processing but also various processings on a roll sheet (such as recording, process, application, irradiation, reading, and inspection).

Figure 1:
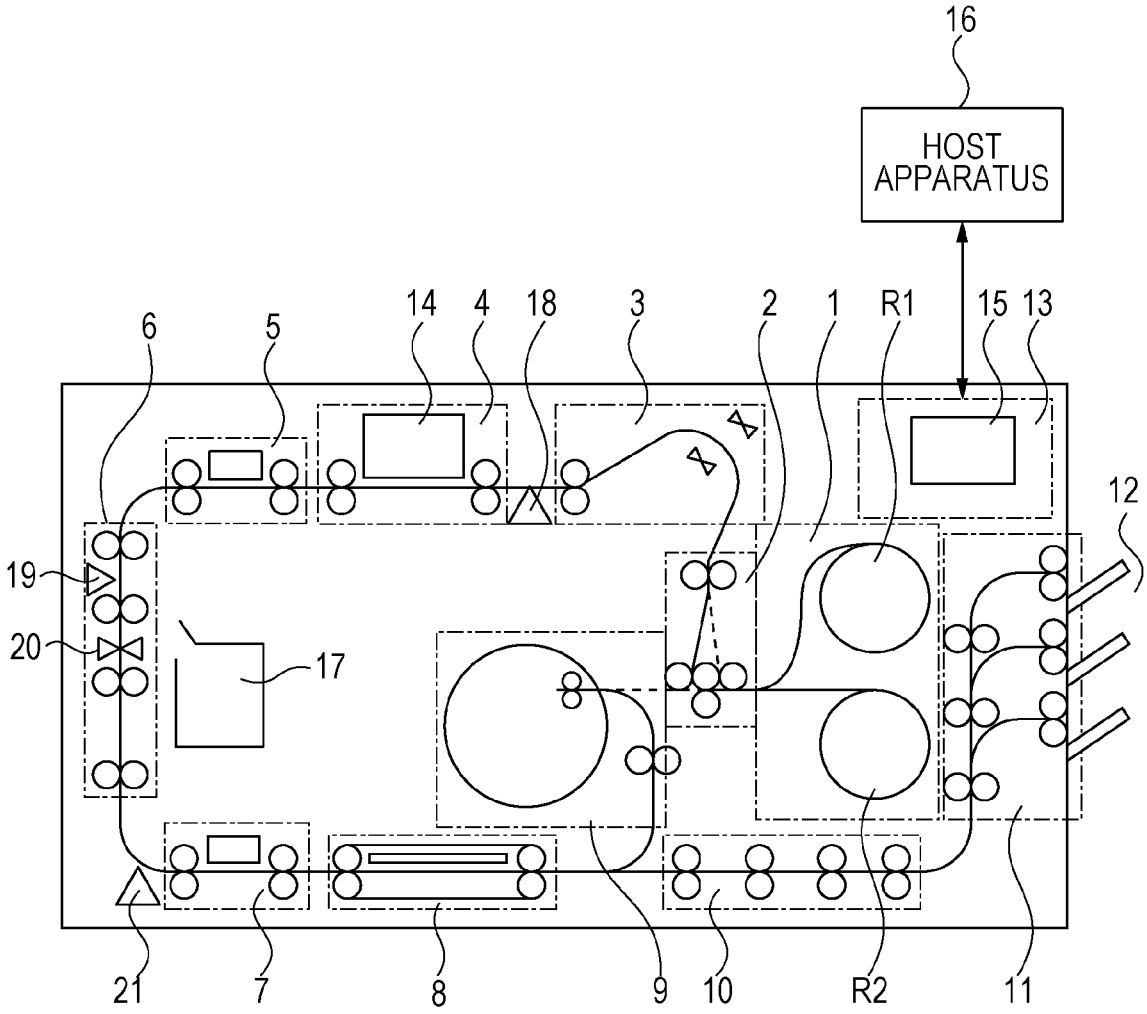
FIG. 1 is a schematic diagram of an internal configuration of a print apparatus.

FIG. 1 is a schematic diagram of a cross section illustrating an internal configuration of the print apparatus. The print apparatus according to the present embodiment can perform the duplex printing on a first surface of the sheet and a second surface on a back side of the first surface by using the sheet wound into a roll. In the print apparatus, roughly, respective units including a sheet feeding unit 1, a decurling unit 2, a skew correction unit 3, a print unit 4, an inspection unit 5, a cutter unit 6, an information recording unit 7, a drying unit 8, a reverse unit 9, a discharge conveyance unit 10, a sorter unit 11, a discharge unit 12, and a control unit 13 are provided. The sheet is conveyed by a conveyance mechanism composed of a roller pair and a belt along a sheet conveyance path represented in the solid line in the drawing and processed in the respective units. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 is a unit for holding and feeding the continuous sheet wound into the roll. The sheet feeding unit can accommodate two rolls R1 and R2 and has a configuration of alternatively pulling out the sheet to be fed. It is noted that the number of rolls that can be accommodated is not limited to two, and the sheet feeding unit may accommodate one roll or three or more rolls. Also, as long as the sheet is a continuous sheet, the sheet is not limited to the sheet wound into the roll. For example, the continuous sheet may be provided with a perforation for every unit length and folded for each perforation to be stacked and accommodated in the sheet feeding unit 1.

The decurling unit 2 is a unit that suppresses a curl (warping) of the sheet fed from the sheet feeding unit 1. In the decurling unit 2, by using two pinch rollers for one driving roller, the sheet is bent and allowed to pass so that a warping in a reverse way to the curl is provided, and a decurling force is affected to suppress the curl.

The skew correction unit 3 is a unit that corrects a skew of the sheet passing through the decurling unit 2 (inclination with respect to the original travelling direction). By pressing a sheet end part on a side serving as the reference against a guide member, the skew of the sheet is corrected.

The print unit 4 is a sheet processing unit that performs a print processing on a sheet by a print head 14 with respect to the conveyed sheet to form an image. In other words, the print unit 4 is a processing unit that performs a predetermined processing on the sheet. The print unit 4 is also provided with a plurality of conveying rollers for conveying the sheet. The print head 14 has a line-type print head in which an inkjet system nozzle array is formed in a range covering a maximum width of a sheet expected to be used. In the print head 14, a plurality of print heads are disposed in parallel in the conveying direction. In the present example, seven print heads corresponding to seven colors including C (cyan), M (magenta), Y (yellow), LC (light cyan), LM (light magenta), G (gray), and K (black) are provided. It is noted that the number of colors and the number of print heads are not limited to seven. For the inkjet system, a system using a heater element, a system using a piezoelectric element, a system using an electrostatic element, a system using an MEMS element, or the like can be adopted. Ink of the respective colors is supplied from an ink tank via respective ink tubes to the print head 14.

The inspection unit 5 is a unit for optically reading an inspection pattern or an image printed by the print unit 4 on the sheet by using a scanner and inspecting a nozzle state of the print head, a sheet conveyance state, an image position, or the like to determine whether the image is correctly printed. The scanner has a CCD image sensor or a CMOS image sensor.

The cutter unit 6 is a unit provided with a mechanical cutter 20 for cutting the sheet after the print at a predetermined length. The cutter unit 6 is further provided with a cut mark sensor 19 that optically detects the cut mark recorded on the sheet and a plurality of conveying rollers for sending out the sheet to the next step. In the vicinity of the cutter unit 6, a dust bin 17 is provided. The dust bin 17 is designed to accommodate small sheet scraps generated while the margin areas are cut off by the cutter unit 6 and discharged as litter. The cutter unit 6 is provided with a sorting mechanism for deciding whether the cut sheet is discharged into the dust bin 17 or shifted to the original conveyance path.

The information recording unit 7 is a unit that records print information (unique information) such as a serial number for the print or a date in a non-print area of the cut sheet. The recording is carried out by printing a character or a code on the basis of the inkjet system, the thermal transfer system, or the like. On the upstream of the information recording unit 7 and also on the downstream of the cutter unit 6, an edge sensor 21 that detects the leading end edge of the cut sheet is provided. In other words, regarding the edge sensor 21, on the basis of the detection timing for the edge sensor 21 that detects the end part of the sheet between the recording positions by the cutter unit 6 and the information recording unit 7, the timing for the information recording unit 7 to perform the information recording is controlled.

The drying unit 8 is a unit for drying the applied ink in a short period of time by heating the sheet printed by the print unit 4. Inside the drying unit 8, heated air is blown to the passing sheet at least from a lower face to dry the ink applied face. It is noted that the drying system is not limited to the system of blowing the heated air but may also be a system of irradiating the sheet surface with electromagnetic waves (ultraviolet rays, ultrared rays, or the like).

The above-mentioned sheet conveyance path from the sheet feeding unit 1 to the drying unit 8 is referred to as first path. The first path has a U-turn shape between the print unit 4 and the drying unit 8, and the cutter unit 6 is located in the midcourse of the U-turn shape.

The reverse unit 9 is a unit for temporarily rolling up the continuous sheet whose front face print is ended when the duplex printing is to be carried out to reverse the front and rear sides. The reverse unit 9 is provided in the midcourse of a path starting from the drying unit 8 via the decurling unit 2 to reach the print unit 4 (loop path) (which will be referred to as second path) for feeding the sheet passing through the drying unit 8 to the print unit 4 again. The reverse unit 9 is provided with a winding rotary member (drum) rotating so as to roll up the sheep. The uncut continuous sheet where the print is performed on the front face is temporarily rolled up by the winding rotary member. When the rolling-up is ended, the winding rotary member inversely rotates, and the wound sheet is sent out in reverse to the rolling-up to be fed to the decurling unit 2 and fed to the print unit 4. The sides of this sheet are reversed, and it is possible to carry out the print on the rear face by the print unit 4. A more specific operation of the duplex printing will be described below.

The discharge conveyance unit 10 is a unit that conveys the sheet cut by the cutter unit 6 and dried by the drying unit 8 to be delivered to the sorter unit 11. The discharge conveyance unit 10 is provided on a path (which will be referred to as third path) which is different from the second path where the reverse unit 9 is provided. In order that the sheet conveyed through the first path is selectively guided to one of the second path and the third path, a path switching mechanism having a movable flapper is provided at a blanching position of the path.

The sorter unit 11 and the discharge unit 12 are provided on a side end of the sheet feeding unit 1 and also on a tail end of the third path. The sorter unit 11 is a unit for sorting the printed sheets when necessary for each group. The sorted sheets are discharged into the discharge unit 12 composed of a plurality of trays. In this manner, the third path has such a layout that the sheet passes below the sheet feeding unit 1 to be discharged on the opposite side to the print unit 4 and the drying unit 8 while sandwiching the sheet feeding unit 1.

As described above, the sheet feeding unit 1 to the drying unit 8 are sequentially provided in the first path. A section after the drying unit 8 is blanched to the second path and the third path. In the midcourse of the second path, the reverse unit 9 is provided, and a section after the reverse unit 9 is merged into the first path. The discharge unit 12 is provided at the tail end of the third path.

The control unit 13 is a unit that governs the control on the respective units of the entire print apparatus. The control unit 13 has a CPU, a storage apparatus, a controller provided with various control units, an external interface, and an operation unit 15 through which a user performs the input and output. An operation of the print apparatus is controlled on the basis of an instruction from a host apparatus 16 such as a controller or a host computer connected via the external interface to the controller.

A mark reader 18 is provided between the skew correction unit 3 and the print unit 4. The mark reader 18 is a reflective optical sensor that optically reads the reference mark recorded on the first surface of the sheet conveyed from the reverse unit 9 from the opposite side to the side where the print is carried out. The mark reader 18 is a light source that illuminates the sheet face (for example, white LED) and a photo diode or the photoreceiver such as an image sensor that detects the light from the illuminated sheet face for each RGB component. The mark can be read on the basis of a change in a signal level of the photoreceiver or an image analysis on image pickup data. As will be described below, by using a detection timing of a reference pattern by the mark reader 18 as a trigger, positions for printing the images on the rear face are set, and recording positions for the cut marks serving as the reference for finally cutting the sheet by the cutter for each unit image are set.

Figure 2:
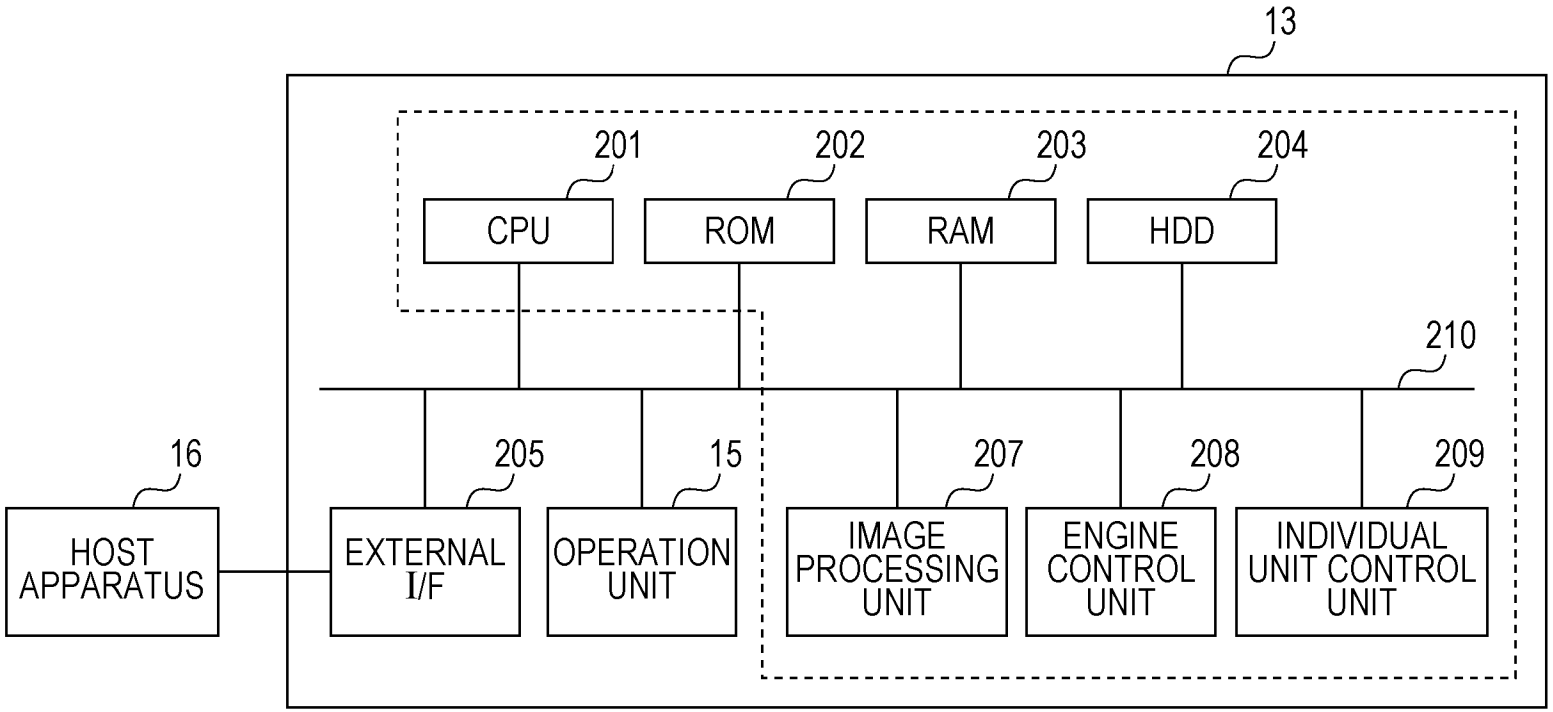
FIG. 2 is a block diagram of a control unit.

FIG. 2 is a block diagram illustrating a concept of the control unit 13. A controller (range surrounded by a broken line) included in the control unit 13 is composed of a CPU 201, a ROM 202, a RAM 203, an HDD 204, an image processing unit 207, an engine control unit 208, and an individual unit control unit 209. The CPU 201 (central processing unit) integrally controls the operations of the respective units in the print apparatus. The ROM 202 stores a program executed by the CPU 201 and fixed data used for various operations of the print apparatus. The RAM 203 is used as a work area for the CPU 201, used as a temporary storage area for various pieces of reception data, and configured to store various pieces of setting data. The HDD 204 (hard disc drive) can store and read the program executed by the CPU 201, print data, and setting information used for various operations of the print apparatus. The operation unit 15 is an input and output interface with the user and includes an input unit such as a hard key or a touch panel and an output unit such as a display for presenting the information or an audio generator.

With regard to a unit required to perform a high speed data processing, a dedicated-use processing unit is provided. The image processing unit 207 performs an image processing on the print data dealt with by the print apparatus. A color space of the input image data (for example, YCbCr) is converted into a standard RGB color space (for example, sRGB). Also, various image processings such as a resolution conversion, an image analysis, and an image compensation are applied on the image data as needed. The print data obtained through these image processings is stored in the RAM 203 or the HDD 204. On the basis of a control command received from the CPU 201 or the like, in accordance with the print data, the engine control unit 208 performs a drive control on the print head 14 of the print unit 4. The engine control unit 208 further performs a control of the conveyance mechanism of the respective units in the print apparatus. The individual unit control unit 209 is a sub controller for individually controlling the respective units of the sheet feeding unit 1, the decurling unit 2, the skew correction unit 3, the inspection unit 5, the cutter unit 6, the information recording unit 7, the drying unit 8, the reverse unit 9, the discharge conveyance unit 10, the sorter unit 11, and the discharge unit 12. The operations of the respective units are controlled by the individual unit control unit 209 on the basis of the instruction of the CPU 201. An external interface 205 is an interface (I/F) for connecting the controller to the host apparatus 16, which is a local I/F or a network I/F. The above-mentioned components are connected via a system bus 210.

The host apparatus 16 is an apparatus functioning as a supply source for the image data to be printed by the print apparatus. The host apparatus 16 may be composed of a general-use or dedicated-use computer or also a dedicated-use image device such as an image capture having an image reader, a digital camera, or a photo storage. In a case where the host apparatus 16 is composed of a computer, an OS, application software for generating image data, and a printer driver for the print apparatus are installed in the storage apparatus included in the computer. It is noted that all of the above-mentioned processings may not be realized by the software, and a part or all of the above-mentioned processings may also be realized by hardware.

Next, a description will be provided of a basic operation at the time of the print. The print has different operations in the simplex printing mode and the duplex printing mode, and therefore each of the print modes will be described.

Figure 3A:
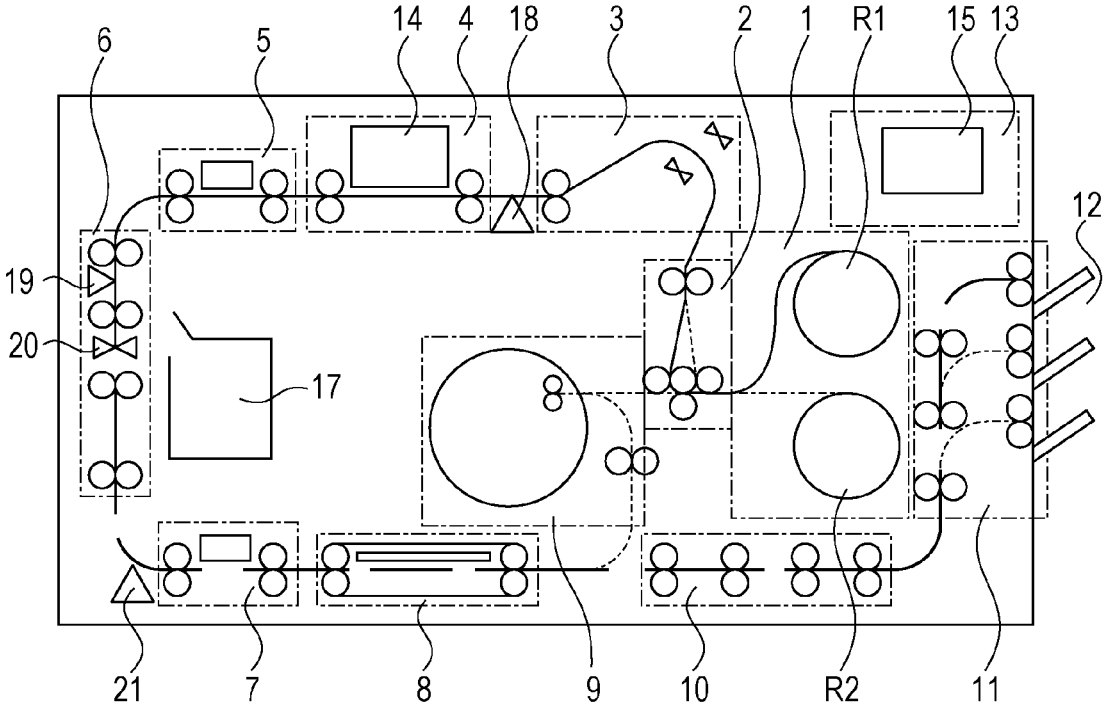
FIGS. 3A and 3B are explanatory diagrams for describing operations in a simplex printing mode and a duplex printing mode.

FIG. 3A is an explanatory diagram for describing the operation in the simplex printing mode. The sheet fed from the sheet feeding unit 1 and processed by the decurling unit 2, the skew correction unit 3 the print unit 4 is subjected to the print on the front face (first surface). On the lengthy continuous sheet, the image having a predetermined unit length in the conveying direction (unit image) is sequentially printed, and a plurality of images are disposed and formed. Herein, a margin area is provided between a certain image and the next image, and a cut mark is recorded in the margin area by the print unit 4. The printed sheet passes through the inspection unit 5 and is cut by the cutter 20 for each unit image on the basis of the detection of the cut mark by the cut mark sensor 19 in the cutter unit 6. On the cut sheet thus cut, as needed, the print information is recorded on the rear face of the sheet by the information recording unit 7. Then, the cut sheet is conveyed one by one to the drying unit 8 for performing the drying. After that, the sheet passes through the discharge conveyance unit 10 and is sequentially discharged into the discharge unit 12 of the sorter unit 11 to be stacked. On the other hand, the sheet remaining on the side of the print unit 4 after the cut of the last unit image is fed back to the sheet feeding unit 1, and the sheet is rolled up by the roll R1 or R2.

In this manner, in the simplex printing, the sheet passes through the first path and the third path to be processed but does not pass through the second path. To elaborate, in the simplex printing mode, under the control of the control unit 13, the following sequence of (1) to (6) is executed:

(1) the sheet is fed out from the sheet feeding unit 1 to be fed to the print unit 4;
(2) the print of the unit image and the cut mark on the first surface of the fed sheet is repeatedly performed by the print unit 4;
(3) the cut of the sheet is repeatedly performed by the cutter unit 6 for each unit image printed on the first surface;
(4) the cut sheet is caused to pass through the drying unit 8 one by one for each unit image;
(5) the sheet passing through the drying unit 8 one by one is caused to pass through the third path to be discharged into the discharge unit 12; and
(6) the last unit image is cut, and the sheet remaining on the side of the print unit 4 is fed beck to the sheet feeding unit 1.

Figure 3B:
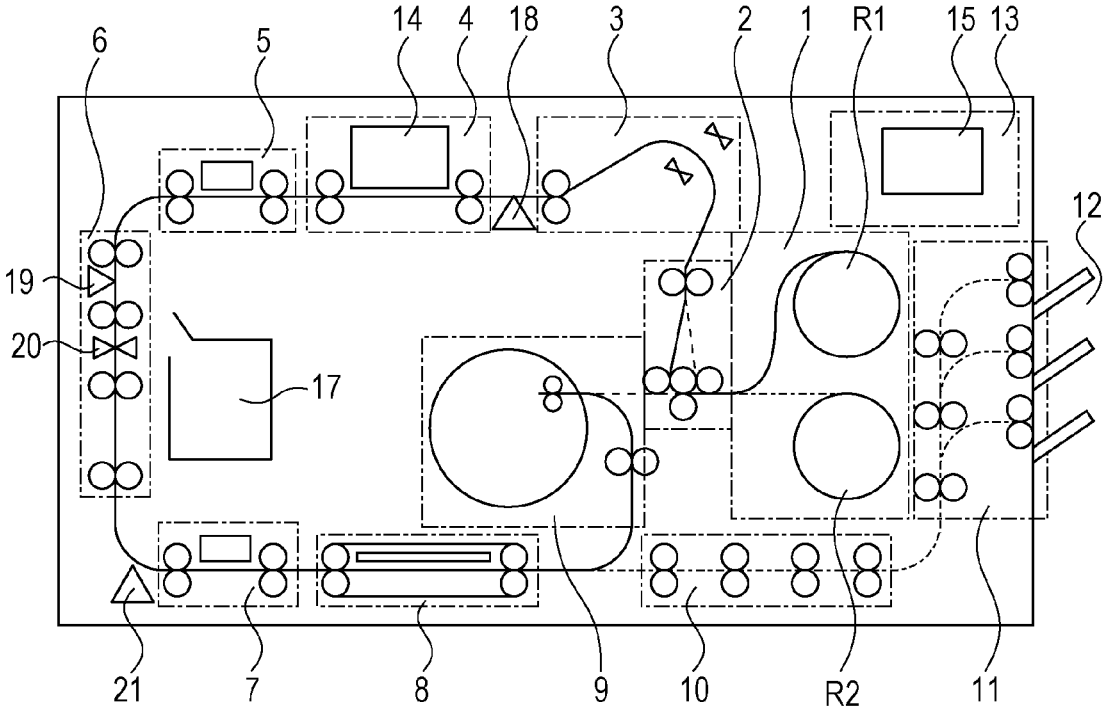

FIG. 3B is an explanatory diagram for describing the operation in the duplex printing mode. In the duplex printing, following the front face (the first surface) print sequence, the rear face (the second surface) print sequence is executed. In the first front face print sequence, the operations of the respective units from the sheet feeding unit 1 to the inspection unit 5 are the same as the above-mentioned operations in the simplex printing. In the cutter unit 6, the cutting operation is not carried out, and the sheet is conveyed to the drying unit 8 as the continuous sheet. After drying the ink on the front face by the drying unit 8, the sheet is guided to the path on the side of the reverse unit 9 (the second path) instead of the path on the side of the discharge conveyance unit 10 (the third path). On the second path, the sheet is rolled up by the winding rotary member of the reverse unit 9 that rotates in a forward direction (in the drawing, a counterclockwise direction). In the print unit 4, when the planed front face prints are all ended, the rear end of the print area of the continuous sheet is cut by the cutter unit 6. While the cut position is set as the reference, the continuous sheet on the downstream side in the conveying direction (the printed side) passes through the drying unit 8 and is rolled up by the reverse unit 9 up to the sheet trailing end (cut position). On the other hand, at the same time as this rolling-up, the continuous sheet remaining on the upstream side in the conveying direction with respect to the cut position (on the side of the print unit 4) is rewound to the sheet feeding unit 1 so that the sheet leading end (cut position) does not remain in the decurling unit 2, and the sheet is rolled up to the roll R1 or R2. By this rewinding, the collision with the sheet fed again in the following rear face print sequence is avoided.

After the above-mentioned front face print sequence, the sequence is switched to the rear face print sequence. The winding rotary member of the reverse unit 9 rotates in a direction reverse to the direction at the time of the rolling up (in the drawing, the clockwise direction). The end part of the wound sheet (the sheet trailing end at the time of the rolling-up becomes the sheet leading end at the time of the feeding-out) is fed into the decurling unit 2 along the path represented by the broken line in the drawing. In the decurling unit 2, the correction on the curl applied by the winding rotary member is carried out. In other words, the decurling unit 2 is provided between the sheet feeding unit 1 and the print unit 4 in the first path and also between the reverse unit 9 and the print unit 4 in the second path and becomes a common unit functioning as the decurling in any of the paths. The sheet whose front and rear sides are reversed passes through the skew correction unit 3 and is fed to the print unit 4 where the print of the unit image and the cut mark on the rear face of the sheet is carried out. The printed sheet passes through the inspection unit 5 and is cut at a predetermined unit length which is set in advance in the cutter unit 6. As the print is carried out on both the sides of the cut sheet has, the recording is not performed by the information recording unit 7. The cut sheet is conveyed one by one to the drying unit 8 and passes through the discharge conveyance unit 10 to be sequentially discharged into the discharge unit 12 of the sorter unit 11 and stacked.

In this manner, in the duplex printing, the sheet passes through the first path, the second path, the first path, and the third path in the stated order to be processed. To elaborate, in the duplex printing mode, under the control of the control unit 13, the following sequence of (1) to (11) is executed:

(1) the sheet is fed out from the sheet feeding unit 1 to be fed to the print unit 4;
(2) the print of the unit image is repeatedly performed by the print unit 4 on the first surface of the fed sheet;
(3) the sheet where the print is performed on the first surface is caused to pass through the drying unit 8;
(4) the sheet passing through the drying unit 8 is guided to the second path and rolled up by the winding rotary member provided to the reverse unit 9;
(5) when the repetitive print on the first surface is ended, the sheet is cut by the cutter unit 6 after the lastly printed unit image;
(6) the sheet is rolled up to the winding rotary member until the end part of the cut sheet passes through the drying unit 8 to reach the winding rotary member. Together with this, the sheet cut and left on the side of the print unit 4 is fed back to the sheet feeding unit 1;
(7) after the rolling-up is ended, the winding rotary member is inverted rotated, and the sheet is fed from the second path to the print unit 4 again;
(8) the print of the unit image and the cut mark is repeatedly performed on the second surface of the sheet fed from the second path in the print unit 4;
(9) the cut of the sheet is repeatedly performed in the cutter unit 6 for each unit image where the print is performed on the second surface;
(10) the cut sheet is caused to pass through the drying unit 8 one by one for each unit image; and
(11) the sheet passing through the drying unit 8 is caused to pass through the third path one by one to be discharged into the discharge unit 12.

Next, in the print apparatus having the above-mentioned configuration, the print control method with which it is possible to suppress the print displacement of the front face and the rear face at the time of the duplex printing will be described in more detail.

Figure 4:
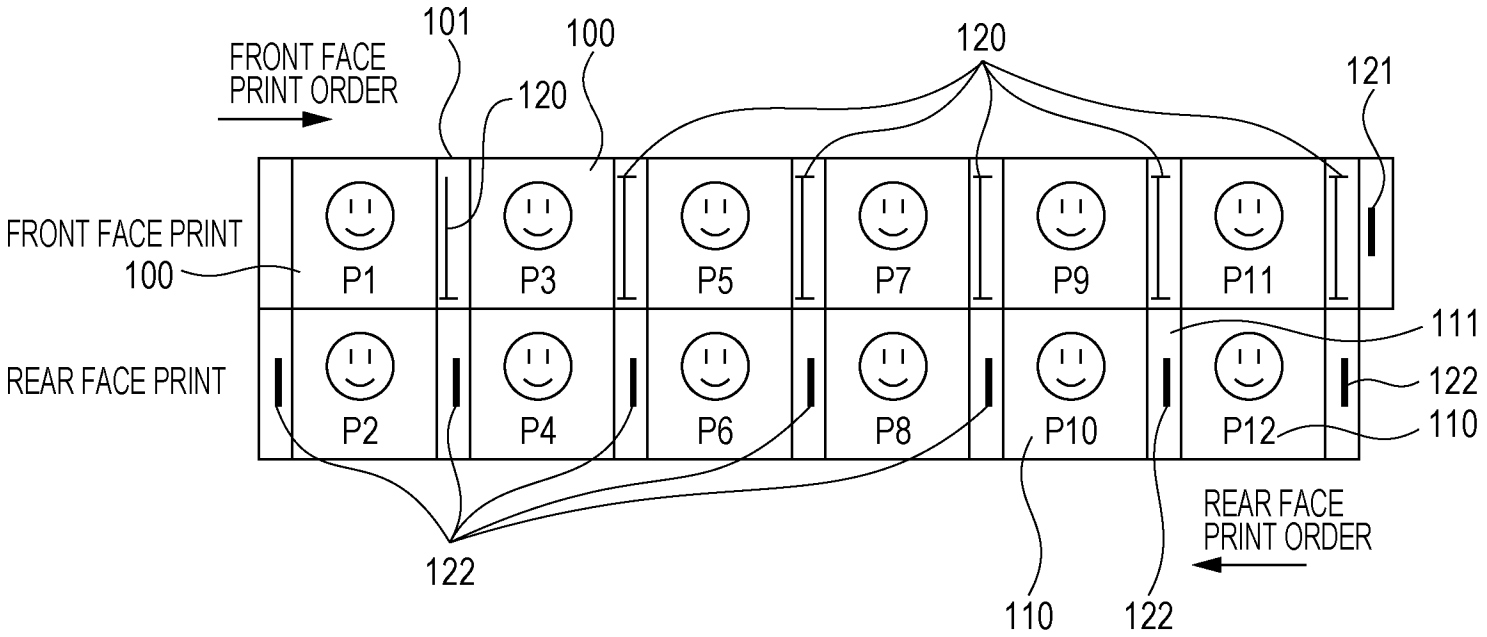
FIG. 4 is an explanatory diagram for describing a print order of a plurality of images (pages) in the duplex printing mode according to a second embodiment.

FIG. 4 is an explanatory diagram for describing a print order of a plurality of images (pages) in the duplex printing mode according to a second embodiment. While following the control of the control unit 13, first, by the print head 14 of the print unit 4, on the front face (first surface) of the sheet, a plurality of images 100 are sequentially printed every two pages also in the page ascending order (odd-numbered pages P1, P3, . . . , P9, P11) in succession. At that time, a reference mark 120 is recorded in each margin area 101 between a certain one image 100 and the next image 100 by the print head 14. In other words, the continuous sequential print of the plurality of images mentioned herein means continuous image print including the recording in the margin area in one face of the sheet.

Figure 5:
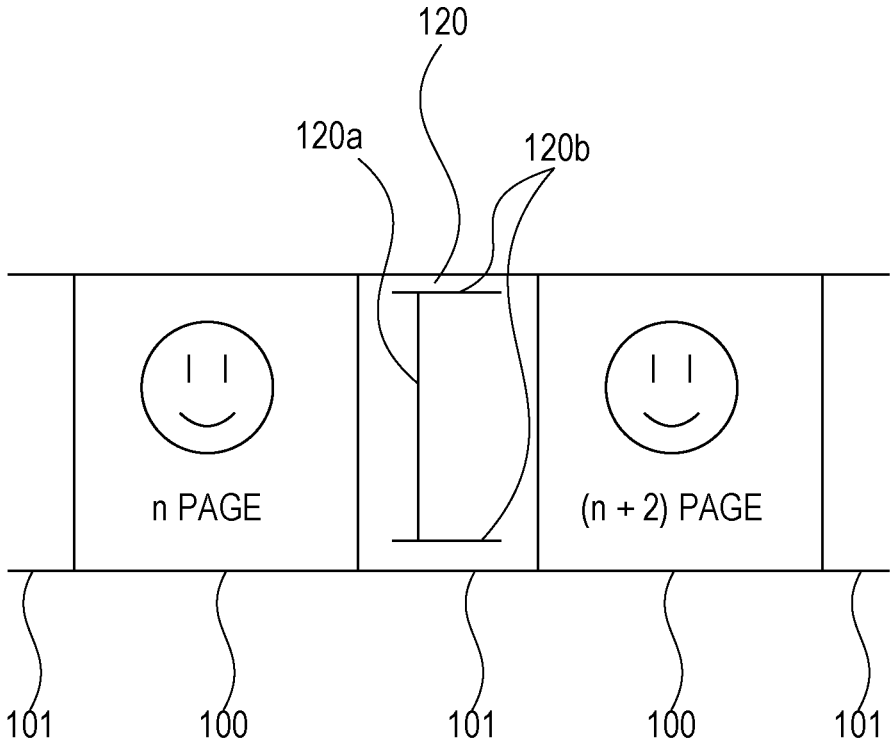
FIG. 5 illustrates a shape example of a reference mark.

The reference mark 120 has a color and a shape which can be clearly identified by the mark reader 18. FIG. 5 illustrates an example of a specific shape of the reference mark. The reference mark 120 is formed in the margin area 101 between one certain image 100 (n-th page: n is an odd number) and the next image 100 ((n+2)-th page). One reference mark 120 is composed of a line segment 120*a* formed along the direction of the sheet width and two line segments 120*b* which are formed along the sheet conveying direction at both ends of the line segment 120*a* and which are shorter than the line segment 120*a*. The mark reader 18 obtains the position information in the sheet conveying direction through the detection of the line segment 120*a*. Furthermore, when the line segment 120*a* is detected at a plurality of positions in the sheet width direction, it is possible to obtain information on an inclination of the sheet (skew component). On the other hand, through the detection of the two line segments 120*b*, it is possible to obtain information on the sheet expansion and contraction in the sheet width direction or the displacement from the interval and the positions thereof. It is noted that the reference mark may omit the line segments 120*b* as long as at least the line segment 120*a* exists because a main aim is to obtain the position information in the sheet conveying direction.

While a plurality of images are printed on the first surface, the sheet area after the print is rolled up by the reverse unit 9. When the last image expected to be printed on the first surface is printed, the print head 14 records a last cut mark 121 in an area after the last image. In the cutter unit 6, the cut mark sensor 19 built in as described above detects the last cut mark 121, and the sheet is cut. The reverse unit 9 rolls up all the cut sheets.

Subsequently, the rear face print is started. In the rear face print, the sheet passes through the print unit 4 in a direction opposite to the direction at the time of the front face print. Thus, on the second surface, a plurality of images 110 are sequentially printed every two pages also in the descending order (even-numbered pages P12, P10, . . . , P4, P2) in succession. The margin area 111 is provided between the respective the images 110, and a cut mark 122 is formed in the margin area 111.

Figure 7:
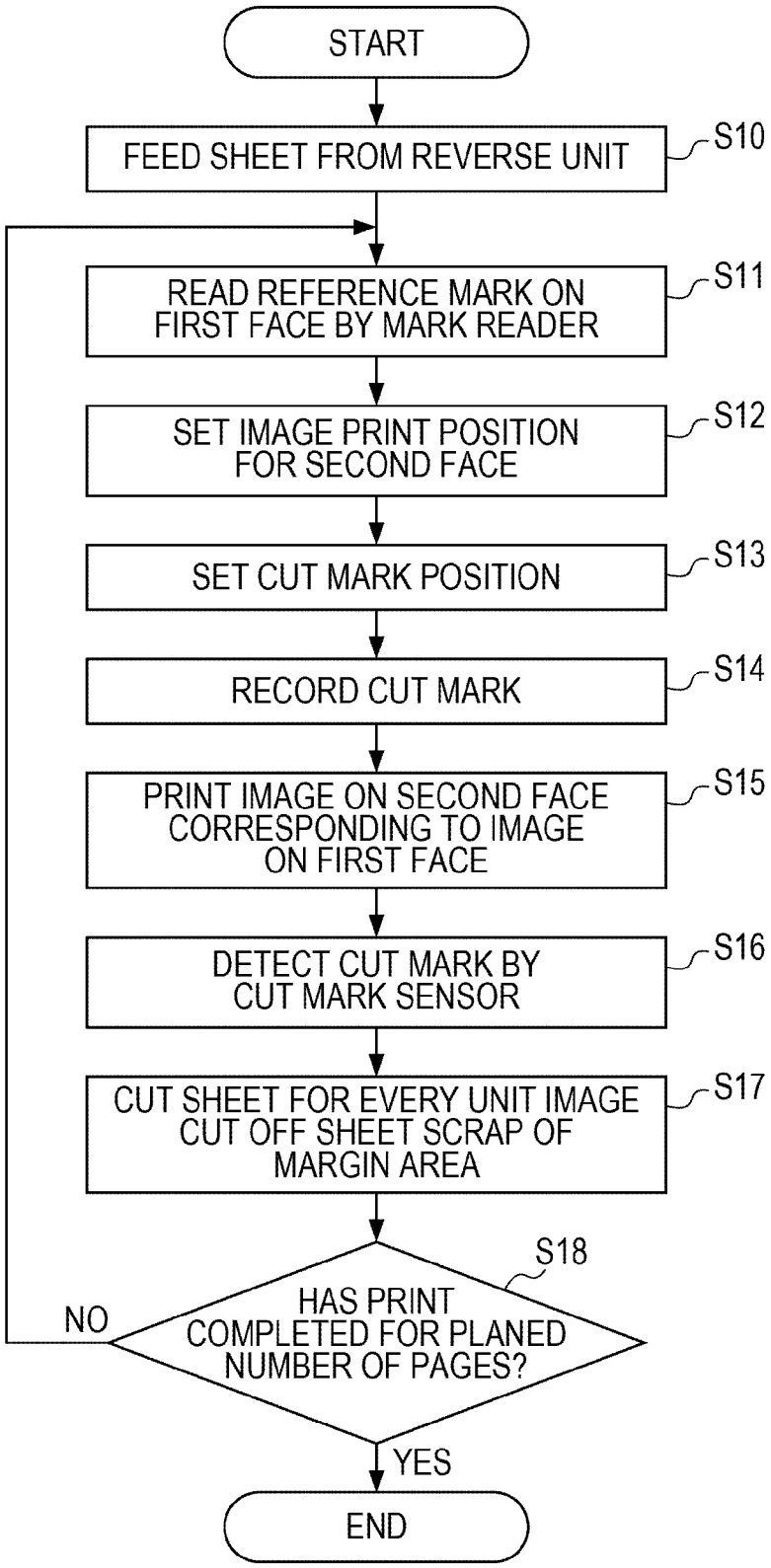
FIG. 7 is a flow chart for an operation sequence in a rear face print.

FIG. 7 is a flow chart for an operation sequence in a rear face print. These operations are executed by the control of the control unit 13. In step S10, the reverse unit 9 inversely rotates to feed the sheet to be fed to the print unit 4 again. In step S11, the reference mark 120 on the first surface of the sheet where the front and rear faces are reversed is read by the mark reader 18 located on the upstream with respect to the print position of the print unit 4. That is, at a faster timing than the start of the print, the reference mark 120 is read. A sheet conveyance speed for the sheets in the print unit 4 is constant, and therefore a time from the reading timing for the reference mark 120 to the start of the print of the corresponding cut mark and image becomes a predetermined time. The following computations in step S12 and step S13 are performed within this predetermined period of time.

In step S12, on the basis of the reading timing of the reference mark 120 in step S11, the image print position for the second surface is computed and set. To be more specific, a print start position for starting the print of the image on the second surface corresponding to the image on the first surface is set. If the image on the first surface and the image to be printed on its rear face have the same size, the image print position on the second surface is at the position precisely matched with the image on the first surface on the front and rear faces.

In step S13, on the basis of the reading timing for the reference mark in step S11, a recording position for the cut mark 122 that should be recorded in the margin area 111 between the one image 110 and the next image 110 on the second surface is computed and set. It is noted that the order of step S12 and step S13 may be swapped. The cut mark 122 has a color and a shape which can be clearly identified by the cut mark sensor 19. The recording position for the cut mark 122 is a position matched on the front and rear faces with the reference mark 120 recorded on the first surface in the sheet conveying direction. It is noted that the reference mark 120 may not necessarily be matched with the cut mark 122 on the front and rear faces, and a slight displacement may be accepted.

In step S14, the cut mark 122 is recorded at the set recording position following the image print in step S13. In step S15, at the set image print position on the second surface, the image corresponding to the image on the first surface is printed. These recording and print are performed while on the basis of the detection signal of the encoder provided to the conveying roller of the print unit 4, at a timing at which the cut mark recording position and the image print position on the sheet passes through the print head 14, the ink is ejected from the print head 14.

In step S16, the cut mark 122 recorded in step S14 on the second surface is detected by the cut mark sensor 19. In step S17, on the basis of the timing at which the cut mark 122 is detected in step S16, the sheet is cut for each unit image. The sheet of the cut unit image (cut sheet) passes through the drying unit 8 and is discharged as the finished product. The margin area is cut off through the cut, and the sheet scrap is discharged as litter. This sheet scrap is discharged into the dust bin 17 provided in the vicinity of the cutter unit 6.

Figure 6:
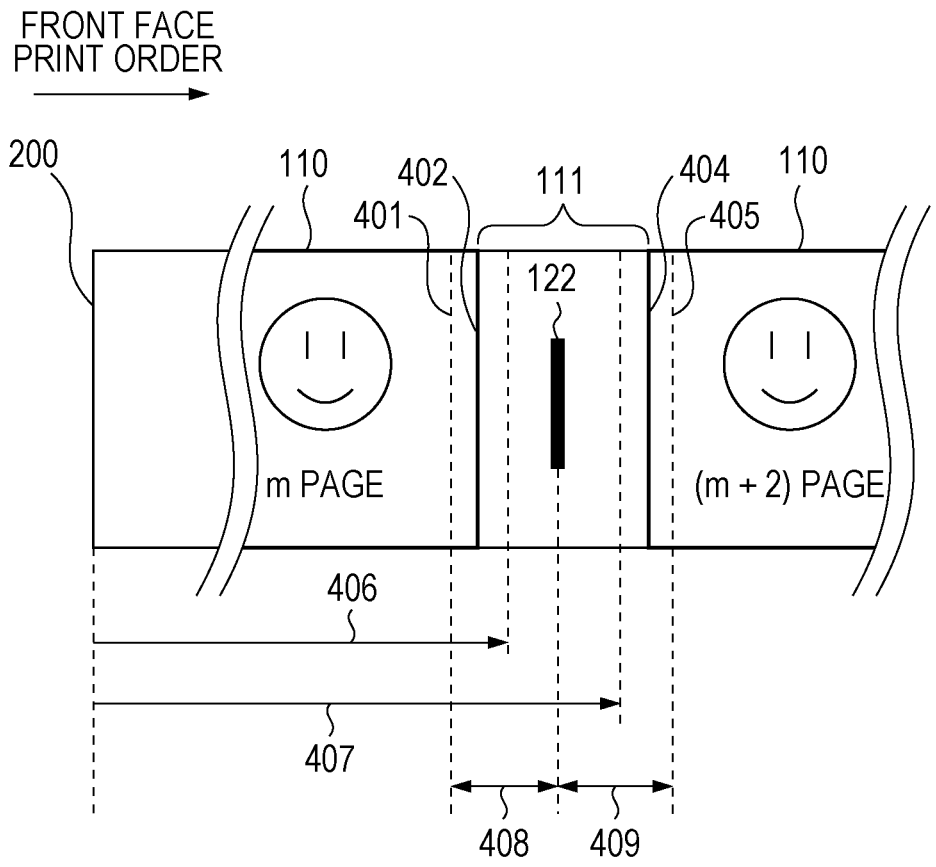
FIG. 6 is an explanatory diagram for describing a technique for a sheet cut by a cutter for each unit image.

Herein, a technique for a sheet cut by the cutter unit 6 for each unit image will be described below. FIG. 6 illustrates the cut mark 122 recorded in the margin area 111 between one image 110 (m-th page: m is an even number)) and the next image 110 ((m+2)-th page) in the rear face print. It is noted that in FIG. 6, for convenience of the description, the arrangement order of the images in the rear face print is left-right reversal to that of FIG. 4. The cut mark 122 is detected by the cut mark sensor 19 built in the cutter unit 6, and the control unit 13 sets the cut position of the sheet on the basis of the detection result to perform a control so that the image printed on the second surface is cut for each unit image.

In the cut mark detection (step S16), in order to reduce the possibility that a part of the images printed before and after the margin area is misidentified as the cut mark, a search range for the detection in the cut mark sensor 19 is limited to a range between a detection start position 406 and a detection end position 407. The detection start position 406 and the detection end position 407 are respectively represented by relative distances from the sheet leading end or an immediately before cut position 200. These positions are set while taking into account the sheet conveyance error. From the information on the already detected one or earlier cut mark and the printed image size, a position where the cut mark is most likely located is obtained, and this position is preferably set as an intermediate position of the search range. An anterior cut position 401 and a posterior cut position 405 are cut positions by the cutter while the cut mark 122 is used as the reference. The respective positions are represented by relative distances from the position of the cut mark 122 (an anterior distance 408 and a posterior distance 409). In a case where a frameless print is performed, the anterior cut position 401 is located to be slightly displaced on the upstream side from a rear end position 402 of the image 110 at the m-th page, and the posterior cut position 405 is located to be slightly displaced on the downstream side from a leading end position 404 of the image 110 at the (m+2)-th page. The respective parameters in the above-mentioned sheet cut are summarized in Table 1.

TABLE 1

| | |
|---|---|
| Detection search range in cut mark sensor (19) | Detection start position (406)<br>Detection end position (407) |
| Cut position by cutter (20) | Anterior cut position (401)<br>Posterior cut position (401) |

While referring back to the flow chart of FIG. 4, in step S18, it is determined whether the print of a plurality of images on the second surface is completed by the expected number of pages (same as the number of pages on the first surface). In a case where a result of the determination is NO, the flow returns to step S11, and a similar operation is repeatedly performed. In a case where the result of the determination is YES, the print sequence is ended.

It is noted that according to the present embodiment, the detection of the cut mark is carried out by the cut mark sensor 19 provided to the cutter unit 6, but the inspection unit 5 may detect the cut mark and the cutting by the cutter may be control from the detection timing.

Incidentally, in the above-mentioned operation sequence in the duplex printing, when the cut mark sensor 19 detects the cut mark, possibilities exist that the cut mark cannot be detected because of various factors, and therefore a recovery unit therefore is preferably provided. Two possibilities exist that either the last cut mark 121 at the rear end on the first surface or the plurality of cut marks 122 on the second surface cannot be detected. First, a case will be described in which the last cut mark 121 cannot be detected.

As an example of a factor causing the detection failure, due to running out of the ink in the print head 14 or temporary clogging of the nozzle, a case exists in which the record failure of the cut mark is caused. Also, due to a partial scratch or dirt on the sheet surface, a case exists in which the record failure of the cut mark is caused. Also, a case exists in which the cut mark sensor 19 receives electric or optical noise and has disconnecting to cause the detection failure.

In a case where the last cut mark 121 recorded at the last of the front face print cannot be detected, it is necessary to estimate the cut mark position in some way. As described with reference to FIG. 6, in the cut mark sensor 19, the search for the cut mark is made in the limited range from the detection start position to the detection end position. In a case where the last cut mark 121 cannot be detected through the search in this range, it is estimated that the cut mark is detected at a certain position in the search range (for example, the intermediate position from the detection start position 406 to the detection end position 407, or the detection end position 407). Then, on the basis of this estimation, the cut position is set, and the sheet is cut by the cutter 20. As the cutting is performed on the basis of the estimation, the end part of the sheet cut and rolled up by the reverse unit 9 (the margin after the last image in the front face print, and this becomes the margin before the leading image in the rear face print) may have a length different from the original length. However, this is the sheet end part where the image does not continue any longer, and no problem occurs.

In a case where the last cut mark 121 cannot be detected, this effect is displayed on the operation unit 15 to notify the user. The user viewing the display performs a maintenance as needed. Subsequently, the rear face print is started. The mark reader 18 reads the reference mark 120 recorded at the beginning of the sheet fed from the reverse unit 9, and by using this as a trigger, the print of the rear face image and the recording of the cut mark are carried out. Therefore, even if the last cut mark 121 cannot be detected, it is possible to certainly perform the duplex printing without receiving the influence.

Next, a description will be provided of a recovery in a case where one of the plurality of cut marks 122 in FIG. 4 cannot be detected. As an example of a factor causing the detection failure, due to running out of the ink in the print head 14 or temporary clogging of the nozzle, a case exists in which the record failure of the cut mark is caused. Also, due to a partial scratch or dirt on the sheet surface, a case exists in which the record failure of the cut mark is caused. Also, a case exists in which the cut mark sensor 19 receives electric or optical noise and has disconnecting to cause the detection failure. Furthermore, a case exists in which the mark reader 18 receives electric or optical noise and cannot obtain the trigger to record the cut mark so that the cut mark is not recorded.

In a case where the cut mark 122 cannot be detected during the rear face print, it is necessary to estimate the position of the cut mark in some way. As described with reference to FIG. 6, in the cut mark sensor 19, the cut mark is searched for in the limited range from the detection start position to the detection end position. In a case where the last cut mark 121 cannot be detected through the search in this range, it is estimated that the cut mark is detected at the intermediate position in the search range (intermediate position from the detection start position 406 to the detection end position 407). The intermediate position in the search range is a most likely position where the cut mark is located that is obtained from the information on the already detected one or earlier cut mark and the printed image size. For that reason, as long as the plurality of cut marks 122 cannot be detected continuously (only one or a small number of the cut marks 122 cannot accidentally be detected in many cases), the estimation has a high reliability to a large degree. After the estimation is made in this manner, as described with reference to FIG. 6, the anterior cut position 401 and the posterior cut position 405 are set to cut the sheet.

To be more reliable, the anterior cut position 401 and the posterior cut position 405 are set in the following manner. The anterior cut position 401 is set at a position added with a predetermined distance on the downstream side as compared with the original configuration, and the posterior cut position 405 is set at a position added with a predetermined distance on the upstream side as compared with the original configuration. In other words, the area sandwiched by the anterior cut position 401 and the posterior cut position 405 (sheet scrap cut off as litter) is narrower as compared with the original configuration. According to this, even when an error exists in the estimation on the position of the cut mark 122, it is possible to reduce the possibility that the end part is missing because of an excess cut of the adjacent images as compared with the original configuration. In this case, the cut sheet cut and discharged into the discharge unit 12 may be larger than another cut sheet in the size in the sheet conveying direction, and a possibility exists that the margin is left at the end part. In view of the above, this effect is displayed on the operation unit 15 to notify the user. To facilitate the visual check by the user, only the cut sheets in which the size may be different are sorted by the sorter unit 11 to be output to a different tray from the other sheets.

In the above, the recording and the detection of the cut mark in the rear face print in the duplex printing mode have been described, but in the simplex printing mode too, a similar operation sequence is performed. That is, in the simplex printing mode too, the cut mark is recorded in the area between one image and the next image to be printed, and when the cut mark is detected, the cut position of the sheet is set on the basis of a detection result. It is however noted that the reference mark is not recorded, but the cut mark is directly recorded. If the cut mark cannot be detected, on the basis of the information on the already detected cut mark, the cut mark position where the detection cannot be performed is estimated, and the cut position of the sheet is set on the basis of this estimation. Then, the sheet after the print is cut at the set cut position. Herein, the cut positions are set at two positions before and after the cut mark, and the area between one image and the next image to be printed is cut off.

According to the above-mentioned embodiment, when a plurality of images are sequentially printed on the first surface of the sheet in succession, the reference mark is recorded in the margin area between one image and the next image to be printed. Herein, the embodiment is not limited to the mode in which the reference marks are recorded in all the margin areas between the images on the first surface. The reference mark may also be recorded once in a predetermined number of images (2 or more). In this case, in the rear face print, on the basis of the one-time detection of the reference mark, across the several images until the next reference mark is detected, the image print positions on the second surface and the cut mark positions are respectively estimated.

Also, according to the above-mentioned embodiment, on the basis of the detection of the reference mark, the cut mark is recorded in the margin area between one image and the next image on the second surface to cut the sheet. Herein, the embodiment is not limited to the mode in which the cut marks are recorded while corresponding to all the detected reference marks. Each time when a predetermined number of the reference marks (2 or more) are detected, the recording of the cut mark may be performed once. In this case, on the basis of the one-time cut mark, the cut positions for a several images are estimated until the next cut mark is detected, and the sheet is cut by the cutter.

As described above, the print position of the image on the second surface is set on the basis of the detection of the reference mark recorded on the first surface, the positions of the images on the first surface and the second surface are accurately matched with each other. In addition, the plurality of reference marks are recorded while the plurality of images are sequentially printed on the first surface. Thus, no matter how much the sheet used in the one-time duplex printing is longer, the print displacement of the images on the front face and the rear face does not occur.

Also, the cut mark is recorded in the margin area between one image and the next image on the second surface on the basis of the detection of the reference mark, and the sheet cut position is set on the basis of the detection of the cut mark to cut the sheet. According to this, it is possible to particularly accurately carry out the sheet cut for each final unit image.

Also, the cut mark is recorded and detected and the cut position of the sheet is set, and even in a case where the cut mark cannot be detected, the cut position of the sheet is set through the estimation. Thus, the sheet cut can be carried out at the accurate position.

Also, on a downstream of the print position, the cut mark is detected by the sensor provided at the position even closer to the cut position. For that reason, even in a case in which the sheet is warped or bent to form a loop in a sheet conveyance path between the print position of the image and the cutter and the sheet lengths fluctuate, it is possible to perform the sheet cut at the accurate position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042347 filed Feb. 26, 2010, which is hereby incorporated by reference herein in its entirety.

What is claimed is:

1. A method of performing duplex printing, the method comprising:

printing, by an inkjet head, a plurality of images on a first surface of a sheet, wherein the sheet is continuous;

recording a reference mark in an area between one image and a next image sequentially printed on the first surface;

reversing, by a reverse unit, the sheet where the plurality of images are printed on the first surface and feeding the reversed sheet for printing by the inkjet head again;

performing, by a decurl unit, decurling of the sheet fed from the reverse unit;

reading the reference mark recorded on the first surface of the reversed sheet fed from the reverse unit through the decurl unit;

setting, based on the reading of the reference mark, a position to be printed of an image on a second surface which is a back of the first surface;

printing, by the inkjet head, a plurality of images on the second surface;

recording a cut mark in a margin area between one image and a next image sequentially printed on the second surface based on the reading of the reference mark;

detecting the cut mark on the second surface within a limited search range which is narrower than the margin area and is set inside the margin area;

setting a first cut position and a second cut position for cutting off the margin area in response to the detection of the cut mark within the limited search range, or setting the first cut position and the second cut position by estimating a position of the cut mark based on information on already detected cut mark in response to no detection of the cut mark within the limited search range;

cutting the sheet at the first cut position and the second cut position; and discharging each of cut sheets on which the images are formed both on the first and second surfaces.

2. The method according to claim 1, further comprising:

estimating, in response to not detecting the cut mark in the search range of the second surface, a position of the cut mark based on information on already detected cut mark; and cutting the sheet based on the estimated position of the cut mark.

3. The method according to claim 1, further comprising:

recording a last cut mark on the first surface after a last image of the plurality of images on the first surface and detecting the last cut mark;

setting, in response to detecting the last cut mark, a cut position of the sheet based on the detection of the last cut mark, and estimating, in response to not detecting the last cut mark, a position of the last cut mark to set the cut position based on the estimation; and cutting the sheet where the printing is performed on the first surface at the set cut position.

4. The method according to claim 1, wherein reversing the sheet includes winding the sheet where the printing is performed on the first surface around a winding rotary member and inversely rotating the winding rotary member to feed the wound sheet to perform the printing on the second surface.

5. An apparatus capable of performing duplex printing, the apparatus comprising:

a sheet feeding unit configured to feed a sheet, wherein the sheet is continuous;

a print unit having an inkjet head configured to perform printing on the sheet fed from the sheet feeding unit;

a reverse unit configured to reverse the printed sheet and feed the reversed sheet to the print unit again;

a decurl unit configured to perform decurling of the sheet fed from the reverse unit;

a reader arranged to read a reference mark recorded on the sheet;

a cutter unit configured to cut the sheet;

a detecting unit configured to detect a cut mark on the sheet; and a control unit, wherein the control unit controls in a manner that:

the print unit prints a plurality of images on a first surface of the sheet, the print unit records the reference mark in an area between one image and a next image sequentially printed on the first surface, the reverse unit reverses the sheet where the plurality of images are printed on the first surface, the decurl unit performs decurling of the sheet fed from the reverse unit, the reader reads the reference mark recorded on the first surface of the reversed sheet fed from the reverse unit through the decurl unit, wherein a position to be printed of an image on a second surface, which is a back of the first surface of the sheet, is set based on the reading of the reference mark, the print unit prints a plurality of images on the second surface of the sheet fed from the reverse unit, the print unit records a cut mark in a margin area between one image and a next image sequentially printed on the second surface based on the reading of the reference mark, the detecting unit detects the cut mark on the second surface within a limited search range, which is narrower than the margin area and is set inside the margin area, in order to set a first cut position and a second cut position for cutting off the margin area based on the detection of the cut mark, the control unit sets a first cut position and a second cut position for cutting off the margin area in response to the detection of the cut mark within the limited search range, or the control unit sets the first cut position and the second cut position by estimating a position of the cut mark based on information on already detected cut mark in response to no detection of the cut mark within the limited search range, and the cutter unit cuts the sheet at the first cut position and the second cut position, and each of cut sheets on which the images are formed both on the first and second surfaces is discharged.

6. The apparatus according to claim 5, wherein the reverse unit includes a winding rotary member which winds the sheet where the printing is performed on the first surface and inversely rotates to feed the wound sheet to the print unit again.

7. The apparatus according to claim 5, further comprising a scanner unit provided between the print unit and the cutter unit and configured to read inspection patterns or images formed on the sheet for inspecting or recovering the print head.

* * * * *